US006310322B1

(12) United States Patent
Yang et al.

(10) Patent No.: US 6,310,322 B1
(45) Date of Patent: Oct. 30, 2001

(54) HEATED ROLLER AND HEATED ROLLER ASSEMBLY

(75) Inventors: Zheng Qing Yang, Kowloon (HK); Yuan Kun Zhang, Nanjing (CN)

(73) Assignee: Raymond Industrial Limited, Shatin (HK)

( * ) Notice: Subject to any disclaimer, the term of this patent is extended or adjusted under 35 U.S.C. 154(b) by 0 days.

(21) Appl. No.: 09/565,800

(22) Filed: May 5, 2000

(51) Int. Cl.[7] ..... A45D 2/36; H05B 1/00

(52) U.S. Cl. ..... 219/386; 219/222; 219/521; 132/229

(58) Field of Search ..... 219/222, 385, 219/386, 521, 534; 132/229, 233

(56) References Cited

U.S. PATENT DOCUMENTS

| | | | | |
|---|---|---|---|---|
| Re. 32,349 | | 2/1987 | Glucksman . | |
| 3,486,000 | | 12/1969 | D'Elia et al. . | |
| 3,488,471 | * | 1/1970 | Gstalder | 219/222 |
| 3,560,704 | | 2/1971 | Albert . | |
| 3,594,543 | * | 7/1971 | Wallin | 219/222 |
| 3,603,765 | | 9/1971 | Underwood . | |
| 3,858,029 | | 12/1974 | Walter . | |
| 3,881,086 | * | 4/1975 | Fleischhauer | 219/222 |
| 4,109,667 | * | 8/1978 | Quirk | 132/233 |
| 4,293,760 | | 10/1981 | Smal . | |
| 4,382,447 | | 5/1983 | Glucksman . | |
| 4,499,355 | | 2/1985 | Walter . | |
| 4,691,095 | | 9/1987 | Barowski et al. . | |
| 4,791,272 | * | 12/1988 | Thaler et al. | 219/222 |
| 5,606,983 | | 3/1997 | Monty et al. . | |
| 5,694,954 | | 12/1997 | Habibi . | |
| 5,808,275 | | 9/1998 | Hibri et al. . | |
| 5,981,908 | | 11/1999 | McGuire et al. . | |
| 5,988,182 | | 11/1999 | Engelbrecht . | |
| 6,107,604 | * | 8/2000 | Hibri et al. | 219/222 |

* cited by examiner

*Primary Examiner*—Joseph Pelham
(74) *Attorney, Agent, or Firm*—Marshall, Gerstein & Borun

(57) ABSTRACT

A heated roller assembly includes a heating platform, a plurality of rollers disposed on the heating platform and a circuit for automatically controlling a surface temperature of each roller. The heated rollers of the heated roller assembly include an outer portion and an inner portion disposed within the outer portion. The inner portion is made of thermoset plastic and includes a groove and a heating element disposed within the groove.

21 Claims, 5 Drawing Sheets

HEATED ROLLER AND HEATED ROLLER ASSEMBLY

TECHNICAL FIELD

The present invention relates generally to electrical devices and, more particularly, to a heated roller and a heated roller assembly.

BACKGROUND OF THE ART

Heated roller assemblies have been used for years to curl or "set" hair. Typically, a heated hair roller assembly includes a plurality of rollers disposed on a metallic heating platform that is heated via a power source, such as electricity. Most conventional assemblies include a housing and a cover attached thereto commonly via a hinge or the like. The cover of the assembly must be in a closed position to properly heat the rollers.

When the rollers have each been sufficiently heated, a user typically removes a roller from the assembly, engages a portion of hair onto the roller, and winds the roller around the hair until the roller is in contact with the user's head. At this point the user typically adheres a clip to the roller and hair wrapped thereon to maintain the position of the roller and hair. The process is repeated with a second roller of the assembly, a third roller, a fourth roller, and perhaps more depending upon how much hair is wrapped around each roller, until all portions of the user's hair are wrapped around one of the rollers. The heated rollers are left in the user's hair for an amount of time (e.g., 5–10 minutes) sufficient to curl the user's hair a desired way.

Each roller of the conventional heated hair roller assembly includes an outer portion and an inner portion, wherein the inner portion is typically made of metal, such as aluminum. The rollers reach the desired curling temperature, which ranges from about 90° Celsius to about 115° Celsius, in not less than 5 minutes.

In addition, most roller assemblies require the cover to be in a closed position during heating, otherwise the rollers are not heated properly, e.g., the rollers take too long to be heated to an adequate curling temperature or sometimes never even reach an adequate curling temperature.

Also, the rollers in the prior art roller assemblies cool rather quickly once they are removed from the heating platform, or source of heat, because of the materials used in constructing each roller. Specifically, the metals used to form the inner portions of the rollers do not retain heat well. As a result, when the rollers are removed from the heat and a user's hair is wrapped thereon, heat rapidly escapes from each roller, thus resulting in sometimes unsatisfactory hair curling.

SUMMARY OF THE INVENTION

The present invention is directed to a heated roller and a heated roller assembly.

More particularly, in accordance with one aspect of the present invention, a heated roller assembly comprises a heating platform and a plurality of rollers disposed on the heating platform. Each roller includes an outer portion and an inner portion. The inner portion is made of thermoset plastic and includes a groove and a heating element disposed within the groove. The heated roller assembly further includes a circuit for automatically controlling a surface temperature of each roller having a control roller disposed adjacent to the plurality of rollers. The control roller includes a temperature sensing element for detecting the surface temperature of the control roller. The circuit further includes a comparator responsive to the temperature sensing element for adjusting the power applied to the heating element of each roller.

More particularly, the inner portion of the assembly may further comprise one of phenolic, epoxy, urea and melamine formaldehyde. The outer portion of each roller may comprise one of aluminum and metal.

In addition, the groove of the inner portion of each roller has a width of about 0.5 millimeter to about 1.0 millimeter. The heating element is preferably embedded within the groove, such that the heating element is not in contact with the outer portion of the roller. The heating element may be a Nichrome wire.

The temperature sensing element may comprise a thermistor.

In addition, the control roller may further comprise a thermofuse for terminating power to the heating element of each roller when the surface temperature of the control roller exceeds a predetermined surface temperature.

In accordance with another aspect of the present invention, a heated roller assembly comprises a heating platform and a plurality of rollers disposed on the heating platform. Each roller includes an outer portion and an inner portion disposed within the outer portion. The inner portion is made of thermoset plastic and includes a groove and heating element disposed within the groove. The heated roller assembly further comprises a circuit for automatically controlling a surface temperature of each roller. The circuit includes a control roller and a comparator. The control roller includes a thermistor for detecting the surface temperature of the control roller and a thermofuse for terminating power to each roller when the surface temperature of each roller exceeds a predetermined surface temperature. The comparator is responsive to the thermistor and adjusts the power applied to the heating element of each roller.

In accordance with another aspect of the present invention, a heated roller for heating hair comprises an outer portion and an inner portion. The inner portion is disposed within the outer portion and is made of thermoset plastic. The inner portion further includes a groove and a heating element disposed within the groove, wherein the width of the groove prevents the heating element from contacting the outer portion.

DESCRIPTION OF THE PREFERRED EMBODIMENT

Figure 1:
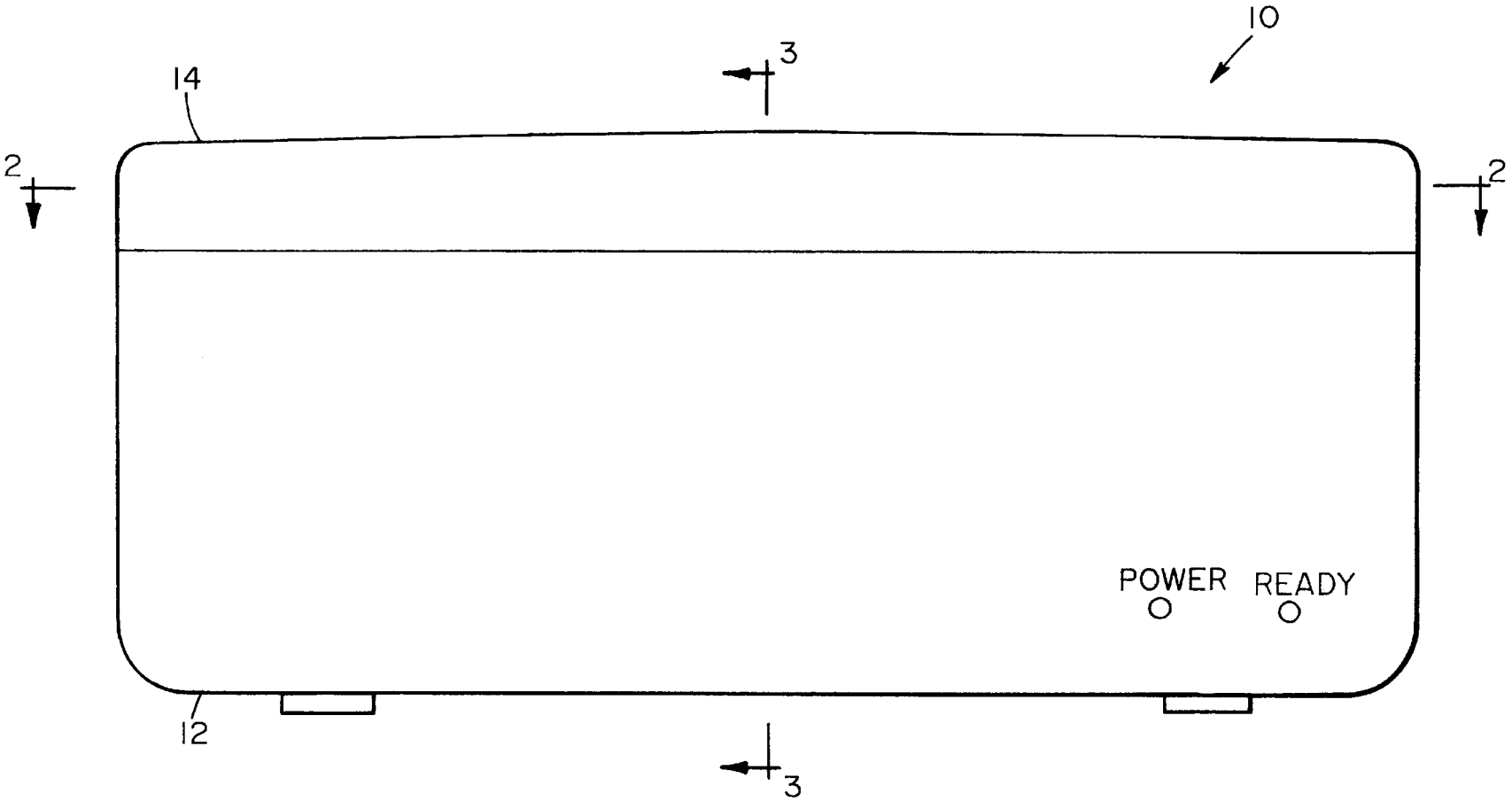
FIG. 1 is a front elevational view of a heated roller assembly according to the present invention.
Figure 2:
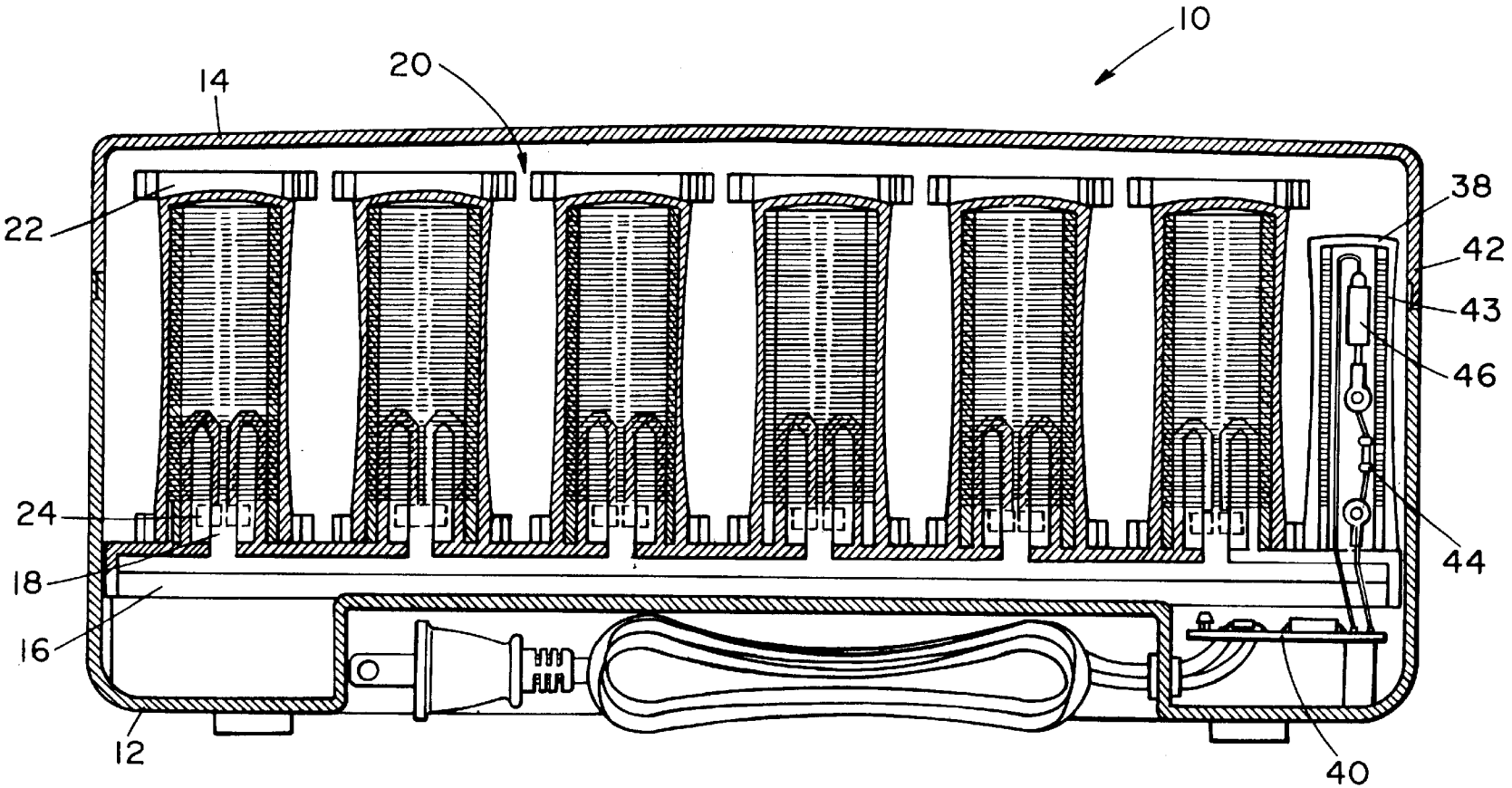
FIG. 2 is a front partially sectional view of the heated roller assembly according to FIG. 1 taken generally along the lines 2—2 of FIG. 1.
Figure 3A:
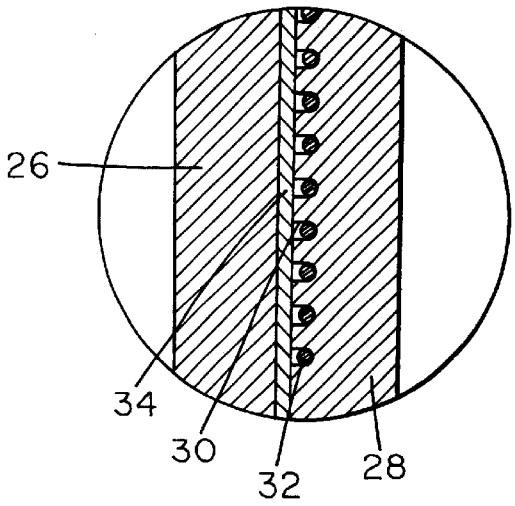
FIG. 3 is a side partially sectional view of the heated roller assembly taken generally along the lines 3—3 of FIG. 1.
Figure 3:
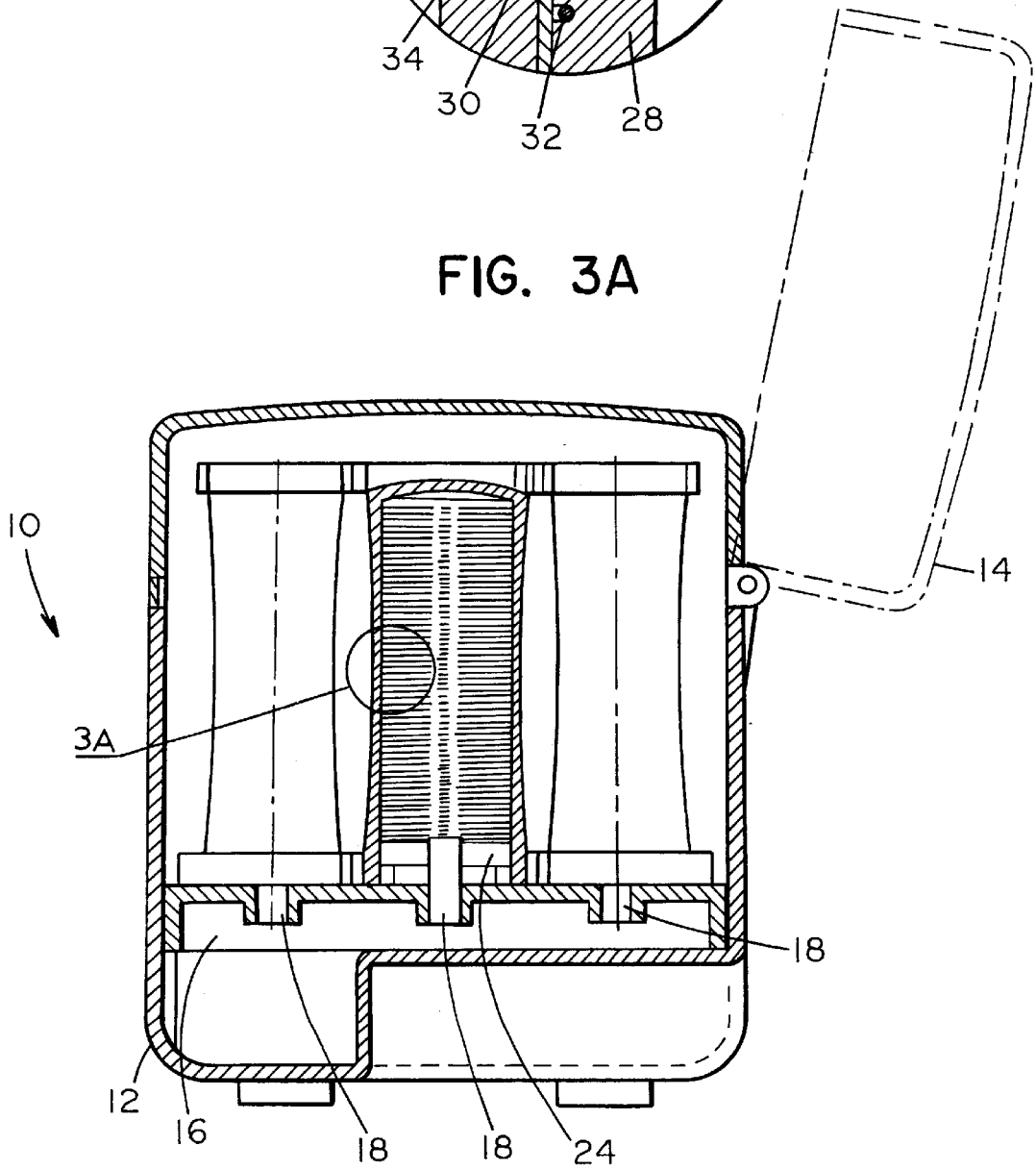

Referring now to FIGS. 1–3, a heated roller assembly 10 of the present invention is shown. The heated roller assembly 10 includes a base 12 and a cover 14. The cover 14 is removably attached to the base 12 via an engaging means, such as a hinge or other similar fastener. The heated roller assembly 10 further includes a non-metallic heating platform 16 having contact plates 18 for conducting an electrical current. The contact plates 18 may be made of a variety of metals, such as phosphor bronze and the like.

A plurality of rollers 20 is disposed on the heating platform 16. Each roller 22 includes at least one contact 24 for communicating with a contact plate 18 (as best shown in FIG. 3), thereby providing electrical current (heat) to the roller 22, as is described more fully hereinafter. The contact 24 also maintains a position of the roller 22 on the heating platform 16. Like the contact plates 18, the contacts 24 may be made of a variety of metals, such as phosphor bronze.

As shown in FIG. 3, each roller 22 further includes an outer portion 26 and an inner portion 28, both of which are typically cylindrical in shape. The outer portion 26 may be made of plastic, aluminum, or a combination thereof. The inner portion 28 is non-conducting and made of thermoset plastic, such as phenolic, epoxy, ceramic, urea and melamine formaldehyde, or a combination thereof. The inner portion 28 includes a groove 30 having a width between about 0.5 millimeter and about 1.0 millimeter. A heating element, such as a heating wire 32, is embedded within the groove 30, such that the heating wire 32 is not in contact with the outer portion 26 of the roller 22. The heating wire 32 may be made of Nichrome and is connected to the contacts 24 of the roller 22.

As further shown in FIG. 3, an insulative sheet 34 may be disposed between the outer and inner portions 26, 28 of each roller 22, to further prevent the heating wire 32 from contacting the outer portion 26 of the roller 22. The insulative sheet 34 is typically made of mica. It should be noted that such insulative sheet 34 is not necessary to prevent the heating wire 32 from contacting the outer portion 26 of the roller 22, for the heating wire 32 is embedded in the groove 30 of the roller 22, and therefore is already not in contact with the outer portion 26 of the roller 22. Because this roller construction (i.e., inclusion of the groove 30 for receiving the heating wire 32) allows each roller 22 to operate without the insulative sheet 34, the rollers 22 of the present invention may be assembled more quickly than conventional rollers having such insulative sheets 34 and ultimately are not as costly to make in light of the removal of the sheet 34.

The heated roller assembly 10 further includes a control circuit 36 for controlling the amount of power applied to the rollers 22. The control circuit 36 comprises a control roller 38 and a voltage comparator 40. The control roller 38 simultaneously controls the temperature of each roller 22, as is more fully explained hereinafter.

The control roller 38 is typically cylindrical in shape and may be disposed on the heating platform 16 in the same manner as the plurality of rollers 20 (as shown in FIG. 2). It should be noted that the control roller 38 may be disposed in a variety of positions surrounding the heating platform 16, such as underneath the heating platform 16. Similar to each roller 22, the control roller 38 has an outer portion 42 that may be made of plastic or aluminum, or a combination thereof, and an inner portion 43 that is non-conducting and made of thermoset plastic, such as phenolic, epoxy, ceramic, urea and melamine formaldehyde, or a combination thereof.

A thermistor 44 is disposed within the control roller 38. The thermistor 44 detects a surface temperature variation of the control roller 38 and transmits a signal indicating such temperature variation to the voltage comparator 40. By sensing the surface temperature variation of the control roller 38, the thermistor 44 is in effect sensing the surface temperature of each roller 22 of the heated roller assembly 10. This is so because each roller 22 and the control roller 38 are constructed in the same manner, for example, both include an outer portion 26, 42 (made of the same material) and an inner portion 28, 43 (made of the same material) having a groove 30 and a heating element 30 disposed within the groove 30. Therefore, by sensing the surface temperature variation of the control roller 38, the thermistor 44 is essentially sensing the temperature variation of each roller 22. Similarly, the control circuit 36 is automatically controlling the power applied to each roller 22, as is more fully explained hereinafter.

Also disposed within the control roller 38 is a thermofuse 46. The thermofuse 46 controls the amount of power supplied to the heating platform 16 by cutting off power if the circuit 36 malfunctions and overheating of the plurality of rollers 20 is detected by the thermistor 44.

Figure 4:
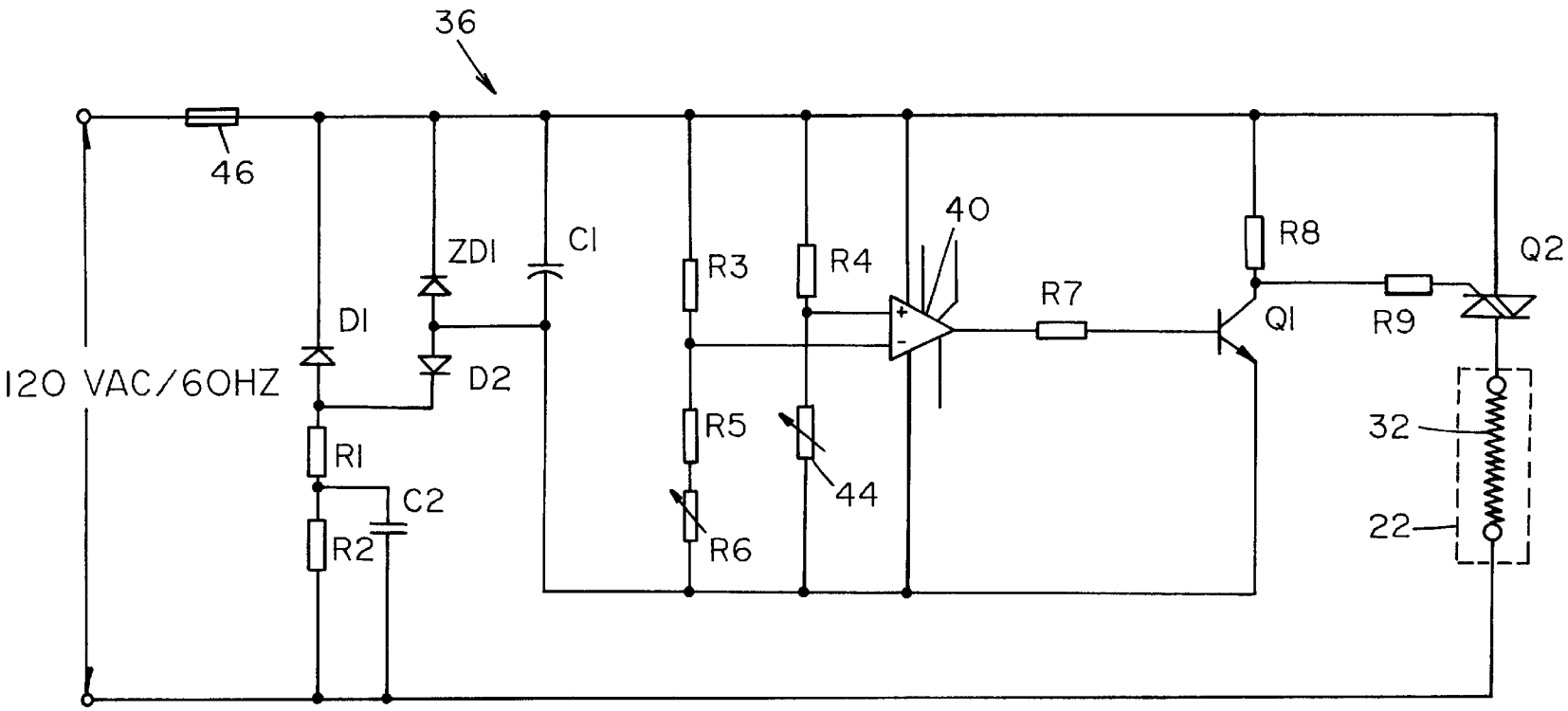
FIG. 4 is a schematic circuit diagram for controlling the heated roller assembly of FIGS. 1–3.

A schematic diagram of the circuit 36 is shown in FIG. 4. Essentially, the circuit 36 automatically controls the amount of power supplied to each of the heating wires 32 of the rollers 22. When power is provided to the circuit 36 via a power source, the power is transmitted through at least one wire to the thermistor 44. More specifically, power is transmitted through resistors Rl, R2, which may have a value of 200 ohms, 2 watts each, R3, R4, which may have a value of 240K ohms, 1/4 watts each, and R5 and R6 which may have a value of 20K ohms, 1/4 watts and 10K ohms, 1/4 W, respectively.

Power is also transmitted through capacitor C1 and C2, which may have a value of 470 $\mu$F, 10V and 1.5 $\mu$F, 250V, respectively, and diodes Dl, D2 and ZD1. The diodes D1 and D2 may be IN4004 and IN4004 respectively, and the diode ZD1 may have a value of 5.6V, 1/2 W. It should be noted that the foregoing examples are illustrative only and that all the resistors, capacitors and diodes may have one of many values.

After power is transmitted through the resistors R1–R6, capacitors Cl and C2 and diodes D1, D2 and ZD1, power is then transmitted to the thermistor 44 disposed within the control roller 38. Because the thermistor 44 is at ambient temperature initially, its resistance value is high. Thus, the input voltage at terminal 3 of the voltage comparator 40 is greater than the voltage at terminal 2 of the voltage comparator 40, thereby causing the output voltage at output terminal 7 to be high. The high voltage at terminal 7 in turn causes a transistor Q1 to be turned on, allowing current to pass through resistors R8 and R9 to transistor Q2. After the current passes through resistors R8 and R9 and to transistor Q2, the transistor Q2 is turned on thereby heating the heating wire 32 embedded within the inner portion of each roller 22.

It should be noted that the resistors R7–R9 and transistors Q1 and Q2 may have one of many values. For example, R7 may have a value of 10 ohms 1/4 W, R8 may have a value of 110 ohms 1/4 W and R9 may have a value of 82 ohms 1/4 W. In addition, Q1 may be 1815 having a $\beta \geqq 180$ and Q2 may have a value of 12 A, 300V.

As the temperature of each roller 22 rises during roller heating, the resistance value of the thermistor 44 decreases, causing the voltage at voltage comparator terminal 3 to gradually become less than the voltage at terminal 2. This reversal of input voltages to the voltage comparator 40 in turn causes the output voltage at terminal 7 to decrease, which then causes the transistor Q1 to be turned off and the transistor Q2 to be turned off, thus cutting off current to each roller 22.

As the temperature of each roller 22 decreases, the resistance value of the thermistor 44 increases again, and the voltage comparator 40 output voltage eventually becomes high, thereby causing the transistor Q1 to be turned on. When the transistor Q1 turns on, transistor Q2 turns on, thereby allowing current to pass through transistor Q2 and the wire 32 of each roller 22 to be reheated. Thus, the voltage comparator 40, essentially, controls the surface temperature of each roller 22.

Figure 5:
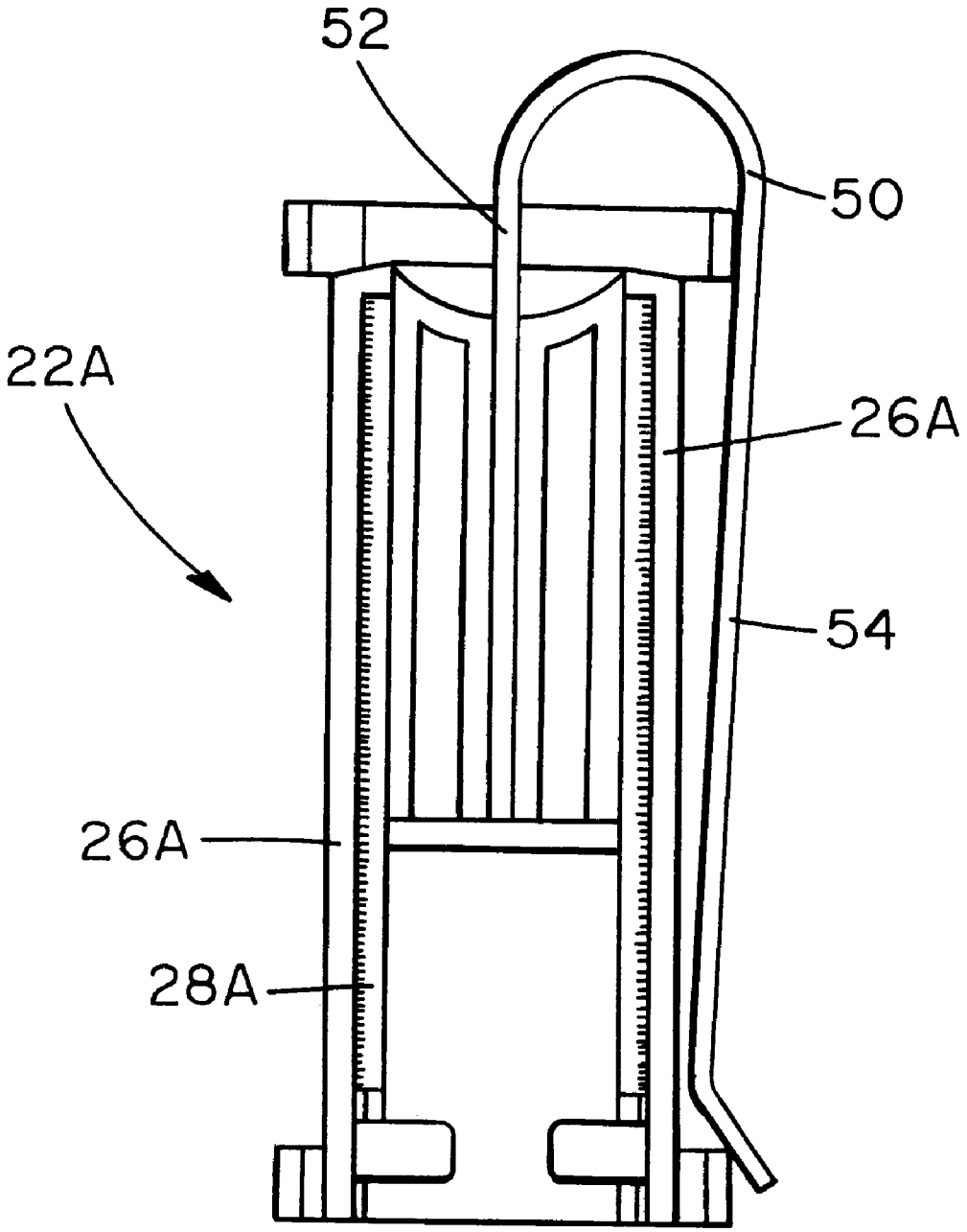
FIG. 5 is a partially sectional view of a heated roller of the heated roller assembly having a clip.

As shown in FIG. 5, a second embodiment of a heated roller 22*a* for the heated roller assembly 10 of the present invention is shown. The roller 22*a* includes an outer portion 26*a* and an inner portion 28*a* disposed within the outer portion 26*a*. The roller 22*a* further includes a clip 50 for adhering hair to the outer portion 26*a* of each roller 22*a*. The clip 50 includes a first portion 52 that is removably attached to the inner portion 28*a* of the roller 22*a*, and a second portion 54 that is disposed adjacent to the outer portion 26*a* of the roller 22. The second portion 54 of the clip 50 removably secures hair to the outer portion 26*a* of each roller 22*a*.

The construction of each roller 22 of the heat roller assembly 10 has several advantages. For example, the use of a thermoset plastic (such as phenolic) for the inner portion 28 of each roller 22 enables the rollers 22 to endure more heat than other materials, such as metal. Because the rollers 22 are capable of enduring more heat, they heat faster than the rollers of the conventional roller assemblies. Specifically, the rollers 22 are capable of being heated to a desired temperature, typically within the range of 90° Celsius to 115° Celsius in less than two minutes.

In addition, the dielectric property of thermoset plastics, e.g., phenolic, is superior to other materials such as metal, therefore electric shock is minimized.

In addition, each roller 22 emits heat at a slower rate than the rollers of conventional hair roller assemblies. Specifically, the surface temperature of the rollers 22 of the present invention cool from a temperature of about 100° Celsius to about 70° Celsius in more than four minutes, as opposed to the rollers of conventional hair roller assemblies which cool from about 100° Celsius to about 70° in less than two minutes. Because the rollers 22 of the present invention retain heat longer than conventional rollers, the heat rollers 22 of the present invention better curl the hair wrapped around each roller 22.

Moreover, the control circuit 36 allows the surface temperature of each roller 22 to be maintained at a desired temperature (e.g., from about 90 degrees Celsius to about 115 degrees Celsius) regardless of whether or not the cover 14 is closed. This is because the circuit 36 automatically adjusts the power supplied to the rollers 22 based on the surface temperature of the control roller 38 (and essentially all the rollers 22) sensed by the thermistor 44. More specifically, the thermofuse 46 of the control circuit 36 automatically cuts off power being supplied to the heating platform if the circuit 36 is malfunctioning and the thermistor 44 is detecting the surface temperature of the control roller 38 to be exceeding a maximum temperature, thereby protecting the rollers 22 from overheating. In addition, the voltage comparator 40 automatically determines whether power should be applied to each roller 22 depending upon the surface temperature of the control roller 38 sensed by the thermistor 44. For example, if the surface temperature sensed is too high, power is not applied to the rollers 22 and if the temperature sensed is below the desired temperature range, power is applied to the rollers to increase the temperature of each roller.

In addition, the heated roller assembly 10 is more efficient than conventional roller assemblies. For example, each roller 22 is capable of being heated to a desired temperature in less than half the time is takes to heat a conventional roller. In addition, power is applied to each roller 22 depending upon the temperature of each roller 22, thereby eliminating the use of excess power while heating such rollers 22. Moreover, because of the unique features of the control roller 38 described in the foregoing, the rollers 22 are capable of being adequately heated even when the cover 14 is not in a closed position.

While the present invention has been described with reference to specific examples, which are intended to be illustrative only, and not to be limiting of the invention, it will be apparent to those of ordinary skill in the art that changes, additions and/or deletions may be made to the disclosed embodiments without departing from the spirit and scope of the invention.

What is claimed is:

1. A heated roller assembly, comprising:

a heating platform;

a plurality of rollers disposed on the heating platform, wherein each roller includes
an outer portion;
an inner portion made of thermoset plastic disposed within the outer portion and having a groove and a heating element disposed within the groove; and a circuit for automatically controlling a surface temperature of each roller including a control roller disposed adjacent to the plurality of rollers and having a temperature sensing element for detecting the surface temperature of the control roller, and a comparator responsive to the temperature sensing element for adjusting the power applied to the heating element of each roller.

2. The assembly of claim 1, wherein the inner portion of each roller comprises one of phenolic, epoxy, urea and melamine formaldehyde.

3. The assembly of claim 1, wherein the inner portion of the roller is non-conducting.

4. The assembly of claim 1, wherein the outer portion of each roller comprises one of plastic and aluminum.

5. The assembly of claim 1, wherein the heating platform is non-metallic.

6. The assembly of claim 1, wherein the groove has a width of about 0.5 millimeter to about 1.0 millimeter.

7. The assembly of claim 1, wherein the heating element is embedded within the groove, such that the heating element is not in contact with the outer portion of the roller.

8. The assembly of claim 1, wherein the heating element is a Nichrome wire.

9. The assembly of claim 1, wherein the temperature sensing element is a thermistor.

10. The assembly of claim 1, wherein the control roller further comprises a thermofuse for terminating power to the heating element of each roller when the surface temperature of the control roller exceeds a predetermined surface temperature.

11. A heated roller assembly, comprising:

a heating platform;

a plurality of rollers disposed on the heating platform, wherein each roller includes
an outer portion;
an inner portion made of thermoset plastic disposed within the outer portion and having a groove and a heating element disposed within the groove; and a circuit for automatically controlling a surface temperature of each roller having a control roller disposed adjacent to the plurality of rollers, wherein the control roller includes a thermistor for detecting the surface temperature of the control roller and a thermofuse for terminating power to each roller when the surface temperature of the control roller exceeds a predetermined surface temperature, and a comparator responsive to the thermistor for adjusting the power applied to the heating element of each roller.

12. The assembly of claim 11, wherein the inner portion of each roller comprises one of phenolic, epoxy, urea and melamine formaldehyde and the outer portion of each roller comprises one of plastic and aluminum.

13. A heated roller for heating hair, comprising:

an outer portion; and an inner portion disposed within the outer portion made of thermoset plastic and having a groove and a heating element disposed within the groove such that the heating elements not in contact with outer portion.

14. The roller of claim 13, wherein the inner portion of each roller comprises one of phenolic, epoxy, urea and melamine formaldehyde.

15. The roller of claim 13, wherein the outer portion comprises one of plastic and aluminum.

16. The roller of claim 13, wherein the groove has a width from about 0.5 millimeter to about 1.0 millimeter.

17. The roller of claim 13, wherein the heating element comprises a Nichrome wire.

18. The roller of claim 13, further comprising at least one contact disposed on the inner portion of the roller.

19. The roller of claim 13, wherein the inner portion of the roller is non-conducting.

20. The roller of claim 13, further comprising a clip for adhering hair to the outer portion of the roller.

21. The roller of claim 20, wherein the clip further comprises a first portion removably attached to the inner portion and a second portion disposed adjacent to the outer portion for securing hair to the outer portion of the roller.

* * * * *

UNITED STATES PATENT AND TRADEMARK OFFICE

CERTIFICATE OF CORRECTION

PATENT NO. : 6,310,322 B1
DATED : October 30, 2001
INVENTOR(S) : Yang et al.

It is certified that error appears in the above-identified patent and that said Letters Patent is hereby corrected as shown below:

Column 7,
Line 22, "disposed" should be -- embedded --.
Line 23, "elements" should be -- element is --.

Signed and Sealed this

Thirtieth Day of July, 2002

*Attest:*

*Attesting Officer*

JAMES E. ROGAN
*Director of the United States Patent and Trademark Office*